US008959977B2

(12) United States Patent
Büsch et al.

(10) Patent No.: US 8,959,977 B2
(45) Date of Patent: Feb. 24, 2015

(54) DEVICE FOR SETTING FASTENING ELEMENTS

(75) Inventors: Martin Büsch, Efringen-Kirchen (DE); Jan-Christian Risy, Binzen (DE)

(73) Assignee: A. Raymond et Cie, Grenoble (FR)

( * ) Notice: Subject to any disclaimer, the term of this patent is extended or adjusted under 35 U.S.C. 154(b) by 381 days.

(21) Appl. No.: 13/514,198

(22) PCT Filed: Nov. 23, 2010

(86) PCT No.: PCT/EP2010/068059

§ 371 (c)(1), (2), (4) Date: Jun. 6, 2012

(87) PCT Pub. No.: WO2011/072996

PCT Pub. Date: Jun. 23, 2011

(65) Prior Publication Data

US 2012/0247174 A1 Oct. 4, 2012

(30) Foreign Application Priority Data

Dec. 18, 2009 (DE) ..... 10 2009 058 982

(51) Int. Cl.

*B21J 15/32* (2006.01)
*B21J 15/26* (2006.01)
*B21J 15/04* (2006.01)

(52) U.S. Cl.

CPC ..... *B21J 15/26* (2013.01); *B21J 15/041* (2013.01); *B21J 15/32* (2013.01); *B21J 15/323* (2013.01)

USPC ..... 72/419; 227/51; 227/52

(58) Field of Classification Search

CPC ..... B21J 15/02; B21J 15/04; B21J 15/041; B21J 15/10; B21J 15/105; B21J 15/12; B21J 15/36

USPC ..... 72/84–86, 391.2, 391.4, 391.6, 419, 72/446–447, 450–451, 453.17, 481.1, 72/482.92; 227/8, 15, 55, 117, 131, 138, 227/51–53, 66, 81, 99; 173/15, 18–19, 49, 173/94, 96–98, 109

See application file for complete search history.

(56) References Cited

U.S. PATENT DOCUMENTS

| | | | | |
|---|---|---|---|---|
| 2,953,842 | A * | 9/1960 | Holtz et al. | 29/839 |
| 3,792,601 | A * | 2/1974 | Dillingham et al. | 72/76 |
| 6,578,254 | B2 * | 6/2003 | Adams et al. | 29/606 |
| 8,061,574 | B2 * | 11/2011 | Lesser et al. | 227/131 |
| 8,397,362 | B2 * | 3/2013 | Burg et al. | 29/243.53 |
| 2007/0158091 | A1 * | 7/2007 | Hsu | 173/217 |

FOREIGN PATENT DOCUMENTS

| | | |
|---|---|---|
| DE | 102005054719 B3 | 5/2007 |
| JP | S5945050A A | 3/1984 |
| JP | 2009515706A A | 4/2009 |

OTHER PUBLICATIONS

The International Search Report as published in the International Patent Application No. PCT/EP2010/068059.

* cited by examiner

*Primary Examiner* — Peter DungBa Vo
*Assistant Examiner* — Joshua D Anderson
(74) *Attorney, Agent, or Firm* — Faegre Baker Daniels LLP

(57) ABSTRACT

The invention relates to a device for setting fastening elements, wherein a master shaft rod can be moved via a master motion link into a forward set position in order to be able to set the fastening element also at inaccessible or vertical locations.

8 Claims, 7 Drawing Sheets

DEVICE FOR SETTING FASTENING ELEMENTS

CROSS-REFERENCE TO RELATED APPLICATION

This application is a U.S. National Phase Patent Application based on International Application No. PCT/EP2010/068059 filed Nov. 23, 2010, the entire disclosure of which is hereby explicitly incorporated by reference herein.

BACKGROUND OF THE INVENTION

1. Field of the Invention

The present invention relates to a device for setting fastening elements.

2. Description of the Related Art

One known device is disclosed in DE 10 2005 054 719 B3. The known device is provided with a set control link having a set control slot, and with a rivet ram connected to a set control pin which in turn engages in the set control slot. Also present is a feed shaft rod to which the set control link is non-rotatably mounted. The device is further equipped with a drive unit, by means of which the feed shaft rod can be driven to rotate in order to move the rivet ram between a retracted, pre-installation position and an extended, installation position. In this way, a fastening element embodied particularly as an expansion rivet can be set mechanically by, for example, pushing a rivet pin in between spring arms of an expansion rivet via the movement of the rivet ram. In this device, a rivet holding head connected to the feed rod protrudes relatively little beyond an end face of a receiving housing, thus resulting in an overall compact design.

SUMMARY OF THE INVENTION

The present invention provides a device for setting fastening elements, which is distinguished by the fact that, with a compact design, fastening elements can be set even at deep-lying or hard-to-access locations.

By virtue of the fact that, in the device according to the invention, the feed shaft rod is movable, under the control of the feed control slot of the feed link and the control of the feed control pin, between a refracted, starting position and an advanced, setting position, fastening elements can be set even in recesses, for example, or in locations that are hard to access due to obstructing components.

In one form thereof, the present invention provides a device for setting fastening elements, including a set control link having a set control slot, a rivet ram connected to a set control pin that engages in the set control slot, a feed shaft rod to which the set control link is non-rotatably mounted, and a drive unit by means of which the feed shaft rod can be driven to rotate in order to move the rivet ram between a retracted, pre-installation position and an advanced, installation position, characterized in that a feed link having a feed control slot is present, in that mounted to the feed shaft rod is a feed control pin that engages in the feed control slot, and in that the feed control slot is so configured that the feed shaft rod, upon rotating, moves between a retracted, starting position and an advanced, setting position.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
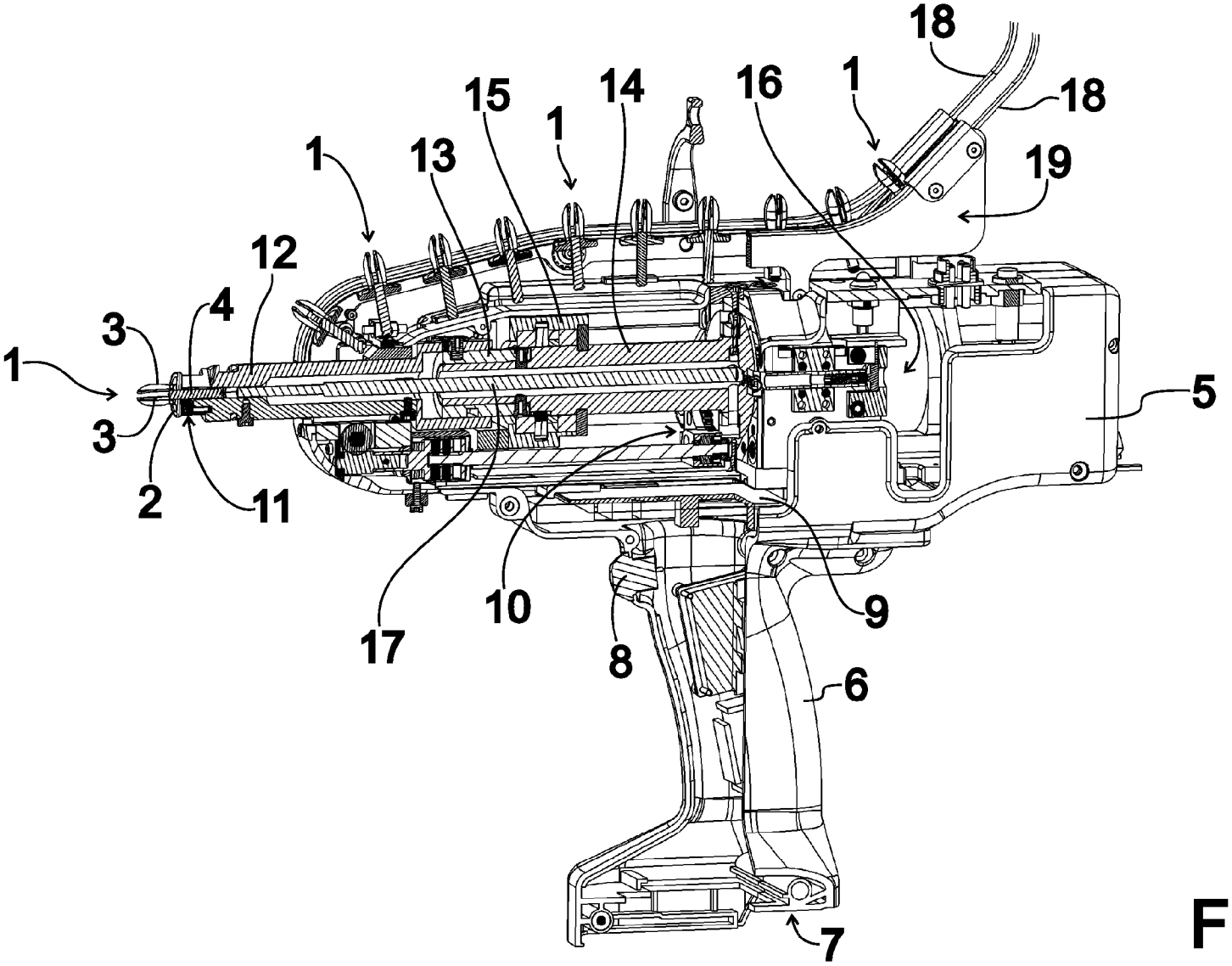
FIG. 1 is a partially cut-away perspective view of an exemplary embodiment of a device according to the invention.

Corresponding reference characters indicate corresponding parts throughout the several views. Although the exemplifications set out herein illustrate embodiments of the invention, in several forms, the embodiments disclosed below are not intended to be exhaustive or to be construed as limiting the scope of the invention to the precise forms disclosed.

DETAILED DESCRIPTION

FIG. 1 shows, in a partially cut-away perspective view, an exemplary embodiment of a device according to the invention for setting fastening elements particularly in the form of expansion rivets 1 having a disk-shaped support disk 2, spring arms 3 formed on one side of the support disk 2, and a rivet pin 4 that can be shifted from a pre-installation position to a final installation position by being pushed through an opening in the support disk 2 and between the spring arms 3 to spread the latter.

The device according to FIG. 1 is configured as pistol-like and has a receiving housing 5 with a pistol-like grip 6, at the free end of which is disposed a battery compartment 7 for connection to a battery, not shown in the representation of FIG. 1, for supplying electrical energy. Provided on the opposite side of the grip 6 from the battery compartment 7 is a trigger button 8 by means of which a drive unit 10 having an electric motor and a transmission can be actuated via a control electronics 9.

The device according to the invention as represented in FIG. 1 is configured with a rivet holding head 11, which operates to hold an expansion rivet 1 by the rivet pin 4 protruding in the pre-installation position beyond the support disk 2 on the side facing away front the spring arms 3, and which is disposed at an end, directed away from the receiving housing 5, of a head sleeve 12, which by its end directed away from the rivet holding head 11 passes into the receiving housing 5 and surrounds a breakout link 13.

The breakout link 13, in turn, is mounted non-rotatably to an end, directed toward the head sleeve 12, of a feed shaft rod 14 rotatably mounted in a bearing part 15. The end of feed shaft rod 14 directed away from breakout link 13 passes into a feed link 16 disposed non-rotatably relative to the receiving housing 5.

Also present is an elongate rivet ram 17, which in the representation of FIG. 1 extends into the feed link 16, and runs from feed link 16 all the way through feed shaft rod 14 into the end of head sleeve 12 that carries rivet holding head 11.

Finally, it can also be seen from the representation of FIG. 1 that the expansion rivets 1 are attached by their support disks 2 to two facing feed belts 18, which can be conveyed to the rivet holding head 11 via a rail arrangement 19 disposed on the outside of the receiving housing 5.

Figure 2:
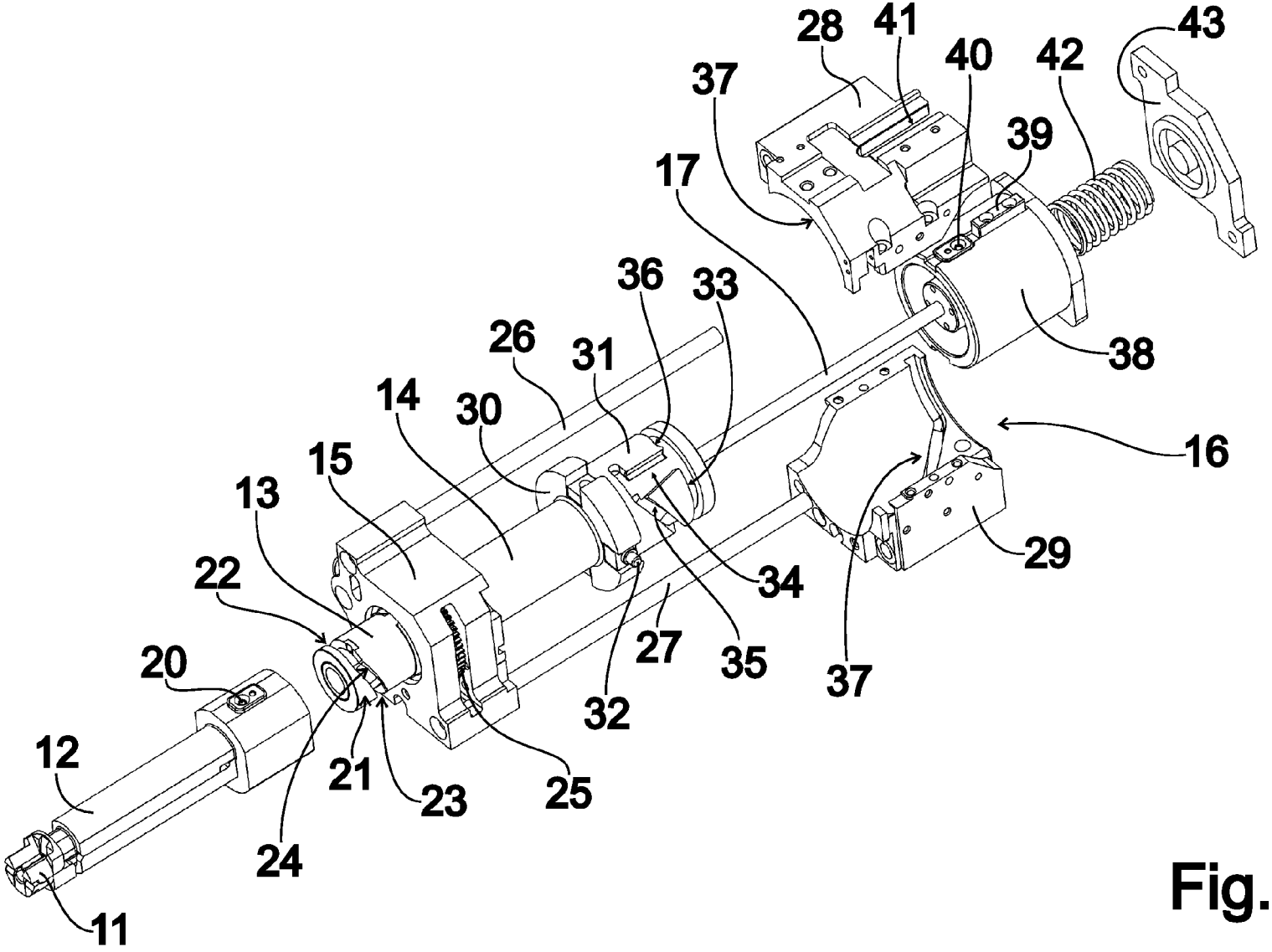
FIG. 2 is a perspective exploded view particularly of a feed shaft rod, a set control link and a feed link of the exemplary embodiment according to FIG. 1.

FIG. 2 shows, in a perspective view, the head sleeve 12, the breakout link 13, the teed shaft rod 14, the bearing part 15 and the feed link 16 according to the exemplary embodiment of FIG. 1. It can be seen from the representation of FIG. 2 that disposed at the end of head sleeve 12 surrounding the breakout link 13 is a breakout control pin 20 adapted to engage in a breakout control slot 21 formed in the breakout link 13. The breakout control slot 21 has a circumferentially extending front section 22 disposed directly at the end of breakout link 13 directed toward rivet holding head 11, and an also circumferentially extending back section 23, which is offset away from rivet holding head 11 with respect to front section 22. Extending between front section 22 and back section 23 is an obliquely extending breakout slanted section 24.

It can also be seen from FIG. 2 that the bearing part 15 surrounding feed shaft rod 14 houses a drive gear 25, which is non-rotatably connected to feed shaft rod 14 and is coupled to the drive unit 10 (not visible in the representation of FIG. 2), in order to drive the feed shaft rod 14 to rotate. Also attached to bearing part 15 are connecting rods 26, 27 provided for displaceable engagement with feed link shells 28, 29 that form the feed link 16.

At its opposite end from the breakout link 13, feed shaft rod 14 comprises a feed bearing ring 30 and a set control link 31, which are also non-rotatably connected to fed shaft rod 14. The feed bearing ring 30 carries a feed control pin 32 that protrudes radially past the feed bearing ring 30. Formed in set control link 31 is a set control slot 33, provided in particular with a set section 34 extending in the axial direction, with a clamping section 35 extending from the end facing the breakout link 13 spirally away from said breakout link 13, and with a holding section 36 extending substantially circumferentially from the end of the clamping section 35 that is directed away from set section 34 toward an opposite end of set section 34 that is directed away from breakout link 13.

It can also be recognized from the representation of FIG. 2 that the feed link shells 28, 29 forming the feed link 16 are configured with a feed control slot 37, which is provided to engage with the feed control pin 32.

Disposed between the feed link shells 28, 29, is a hollow-cylindrical bearing sleeve 38, which carries a radially outwardly projecting slide block 39 and a radially inwardly extending set control pin 40 provided to engage with the set control slot 33. Mounted centrally inside the bearing sleeve 38 is the rivet ram 17.

The rivet ram 17 is disposed centrally in bearing sleeve 38, whose slide block 39 is slid in a slide slot 41 extending in the axial direction in a feed link half shell 28, to connect bearing sleeve 38 non-rotatably to feed link 16.

A setting compression spring 42 engages in the bearing sleeve 38 at its end directed away from the rivet ram 17, and bears at one end against the rivet ram 17 and at the other end against a stop plate 43 that faces the bearing sleeve 38.

Figure 3:
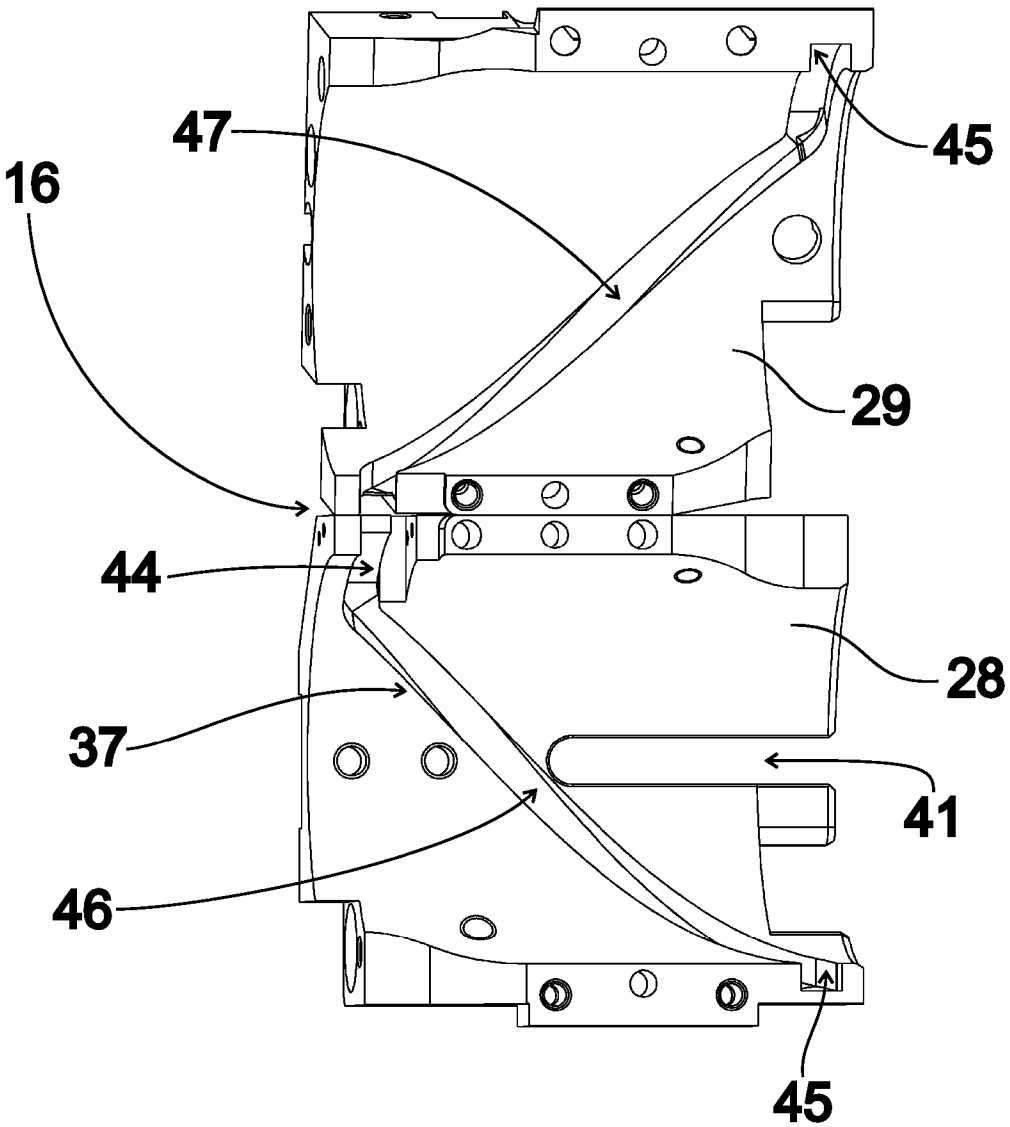
FIG. 3 is a view of the feed link composed of two feed link shells in the exemplary embodiment according to FIG. 1 and FIG. 2.

FIG. 3 shows the feed link shells 28, 29 forming the feed link 16, in a view of the inner side that faces the feed control pin 32. It is clearly evident from the representation of FIG. 3 that the feed control slot 37 has a protrusion section 44 which in the intended arrangement faces the breakout link 13, and a retraction section 45 opposite the protrusion section 44, between which extend spirally extending, stepless, slanted feed sections 46, 47.

The manner of operation of the above-described exemplary device according to the invention will now be described with reference to the representations of FIG. 4 to FIG. 7.

Figure 4:
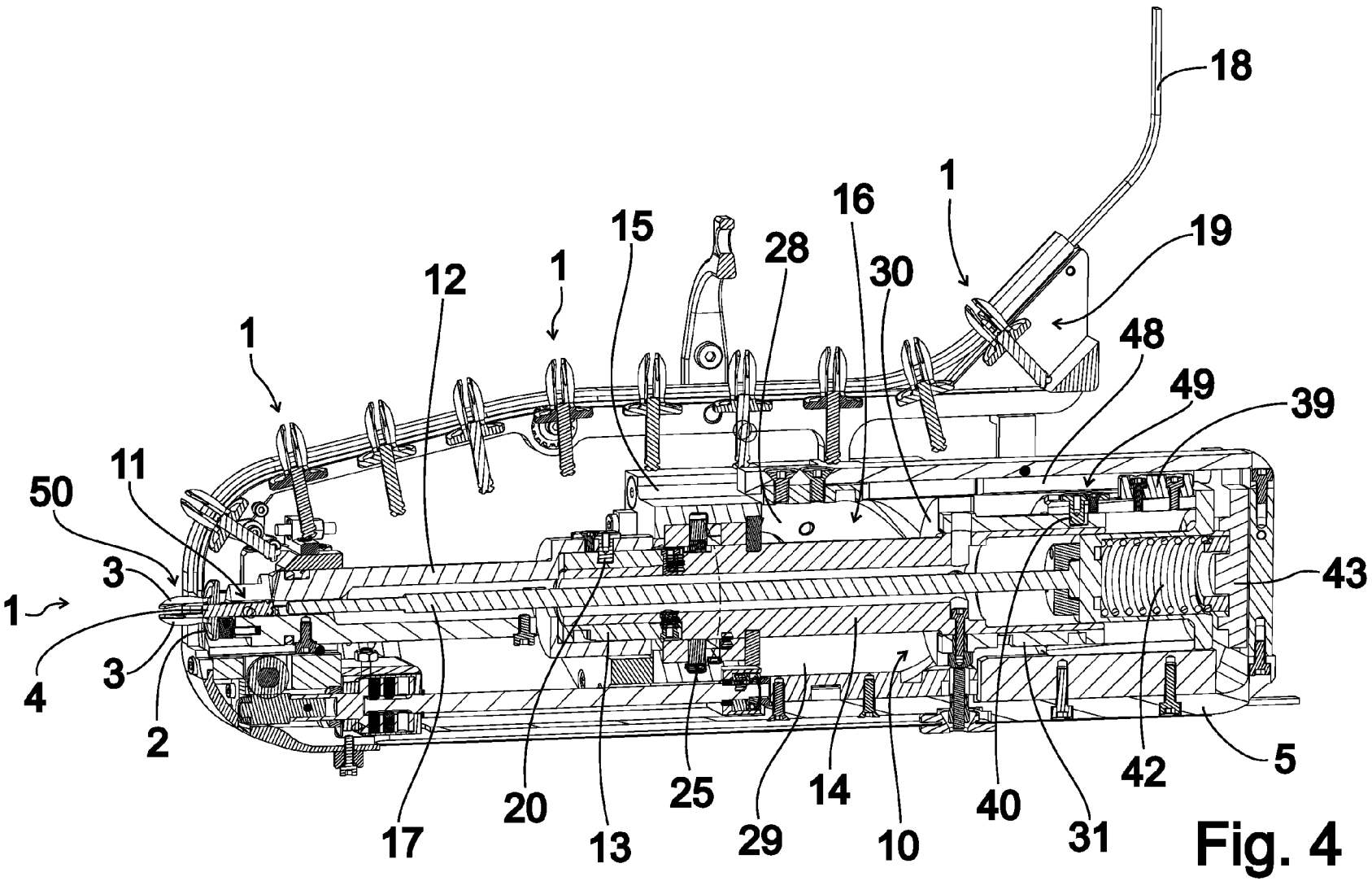
FIG. 4 is a perspective sectional view of the exemplary embodiment according to FIG. 1 with the feed shaft rod in a starting position.

FIG. 4 is a perspective sectional representation of the exemplary embodiment of FIG. 1 with the rivet ram 17 in a retracted, pre-installation position, in which the set control pin 40 is disposed in the holding section 36 of the set control slot 33 and the setting compression spring 42 is under maximum tension. The feed shaft rod 14 and thus also the head sleeve 12 mounted thereto are also in a retracted, starting position, in which the feed control pin 32 is disposed in the retraction section 45 of the feed control slot 37 and the slide block 39 is disposed in a slide rail 49 provided in a guide plate 48 and aligned with the slide slot 41, on the side of feed link 16 facing away from feed bearing ring 30. The rivet pin 4 of the expansion rivet 1 disposed at an exit face 50 of the device according to the invention passes through a slit dimensioned for this purpose and into the rivet holding head 11, the support disk 2 still being connected to the feed belts 18.

Owing to the arrangement of the breakout control pin 20 in the back section 23 of the breakout control slot 21, the head sleeve 12, in order to permit unimpeded entry by the rivet pin 4, is in a retracted, ready position in which the end face of the rivet holding head 11 facing the support disk 2 is spaced apart from the support disk 2.

Figure 5:
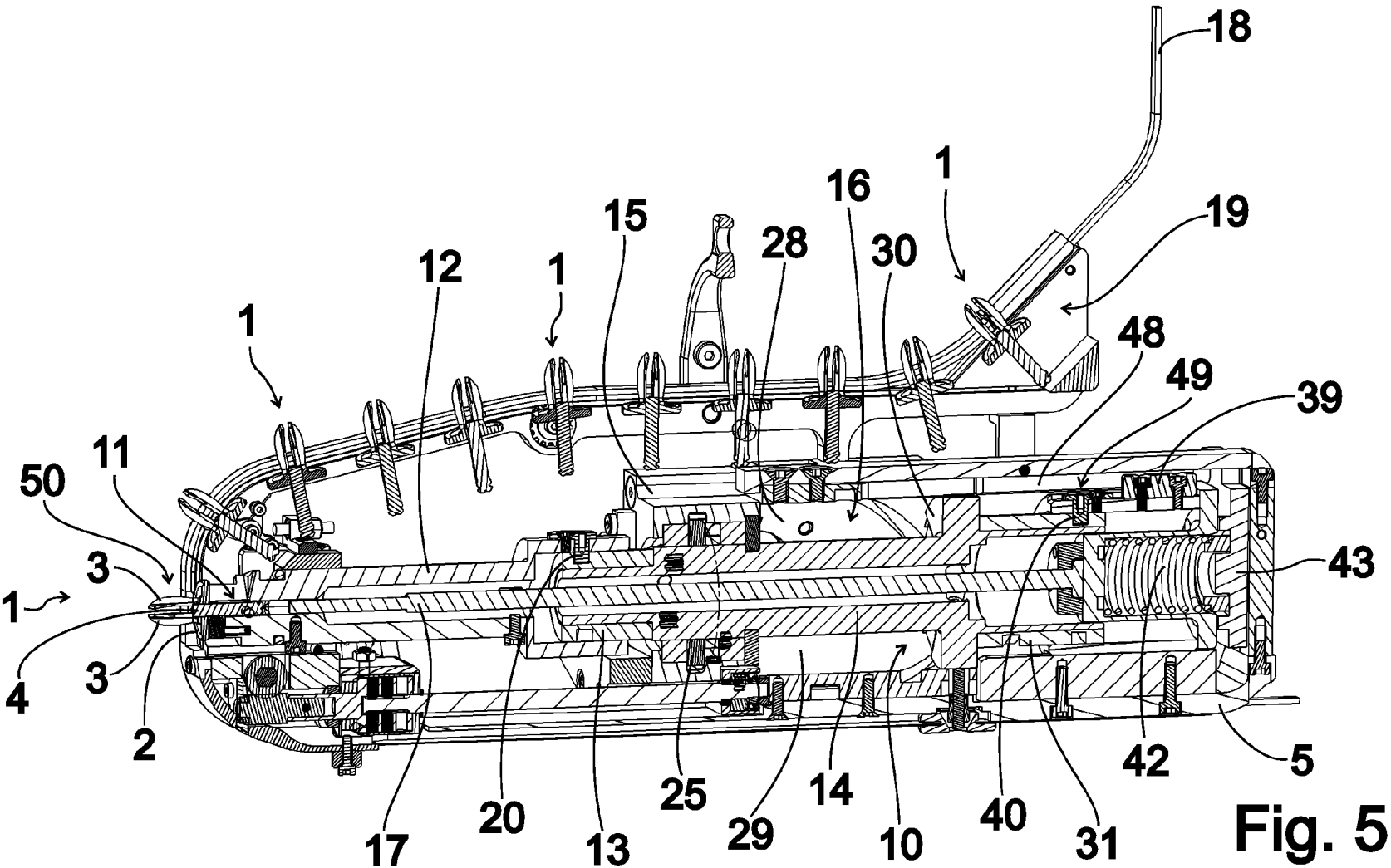
FIG. 5 is a sectional perspective view of the exemplary embodiment according to FIG. 1 with the feed shaft rod in a breakout position.

FIG. 5 shows the arrangement of FIG. 4 during a setting cycle, in a transitional position of feed shaft rod 14 in which it is rotated with respect to the arrangement of FIG. 4, and in which the breakout control pin 20 is now disposed in the front section 22 of the breakout control slot 21 and, by corresponding advancement of the head sleeve 12, the expansion rivet 1 has been broken out of the feed belts 18 and the end of the rivet pin 4 directed away from the support disk 2 is surrounded by the rivet holding head 11. The feed shaft rod 14 is in the same position as in the representation of FIG. 4, since the feed control pin 32 is still in the retraction section 45 of the feed control slot 37 and the set control pin 40 is still in the holding section 36 of the set control slot 33.

Figure 6:
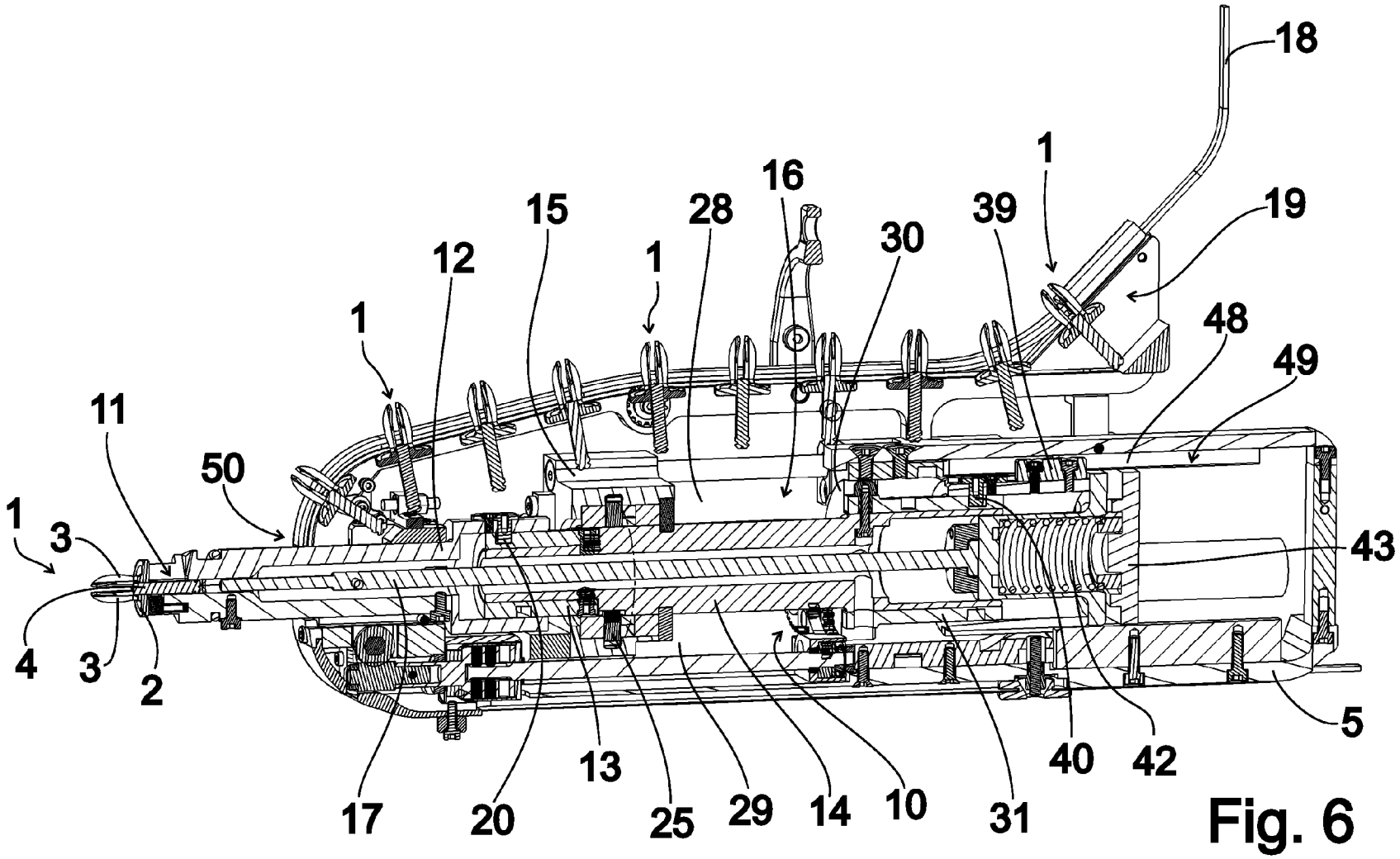
FIG. 6 is a sectional perspective view of the exemplary embodiment according to FIG. 1 with the feed shaft rod in a setting position.

FIG. 6 shows the arrangement according to FIG. 4 and FIG. 5 with the assembly comprised of head sleeve 12, feed shaft rod 14 and bearing sleeve 38 in an advanced, setting position, in which the expansion rivet 1 is now a relatively large distance from the exit face 50. This setting position, which permits very easy access even to deep-lying application sites or sites that would be difficult to access with a shorter projecting length of head sleeve 12 past exit face 50, has been arrived at from the arrangement of FIG. 5 by further rotation of the feed shaft rod 14, brought about by the feed control pin 32 having moved from the retraction section 45 through a slanted feed section 46, 47 into the protrusion section 44. The setting compression spring 42 remains under tension, since the set control pin 40 is still positioned in the holding section 36 of the set control slot 33.

Figure 7:
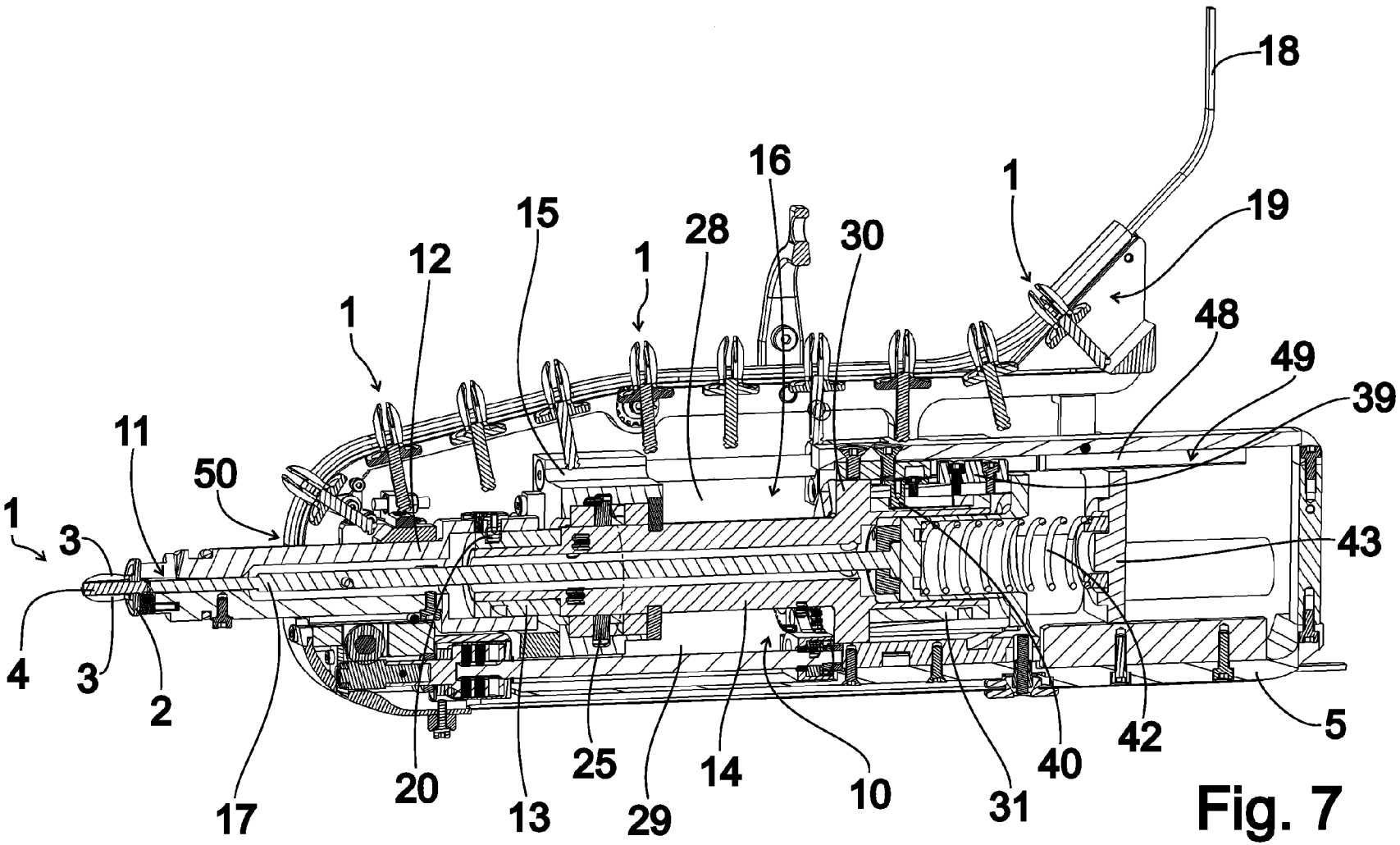
FIG. 7 is a sectional perspective view of the exemplary embodiment according to FIG. 1 with the feed shaft rod in the setting position and a rivet ram in an advanced, installation position.

FIG. 7 shows the arrangement of FIG. 4 to FIG. 6 after a pressing of the trigger button 8 has caused the feed shaft rod 14, with the rivet ram 17, to rotate from the arrangement of FIG. 6 to an advanced, installation position, the rivet pin 4 having been pushed in between the spring arms 3 of the now set expansion rivet 1. In this installation position, the setting compression spring 42 is in a relatively relaxed arrangement, after moving the rivet ram 17 abruptly away from the stop plate 43 once the set control pin 40 has been guided into the set section 34 of the set control slot 33.

Proceeding from the arrangement of FIG. 7, after the trigger button 8 is released, as a result of further rotation of the feed shaft rod 14 there is a return to the starting position and pre-installation position depicted in FIG. 4, and the next expansion rivet 1 is introduced into the rivet holding head 11 until the arrangement of FIG. 6 is reached again.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A device for setting fastening elements, comprising:

a receiving housing;

a feed shaft rod;

a set control link non-rotatably mounted to said feed shaft rod, said set control link having a set control slot;

a rivet ram connected to a set control pin, said set control pin engaging in said set control slot;

a drive unit operable to rotate said feed shaft rod to move said rivet ram between a retracted, pre-installation position and an advanced, installation position;

a feed link having a feed control slot, said feed control slot including a protrusion section, a retraction section opposite said protrusion section, and a pair of feed sections extending between said protrusion section and said retraction section; and a feed control pin mounted to said feed shaft rod, said feed control pin engaging in said protrusion, retraction, and feed sections of said feed control slot, said feed control slot configured such that said feed shaft rod, upon rotating, moves in an axial direction with respect to said receiving housing between a retracted, starting position in which said feed control pin is disposed in said retraction section and an advanced, setting position in which said feed control pin is disposed in said protrusion section.

2. The device of claim 1, wherein said set control slot and said feed control slot are shaped such that said rivet ram moves from said pre-installation position to said installation position when said feed shaft rod is in said setting position.

3. The device of claim 1, wherein said feed control slot is formed in two feed link shells that surround said feed shaft rod.

4. The device of claim 1, wherein said feed control slot includes two stepless slanted feed sections extending between said retraction section and said protrusion section.

5. The device of claim 1, wherein said feed control pin is mounted to a feed bearing ring projecting at least partially radially beyond said set control link, said feed control pin projecting radially beyond said feed bearing ring.

6. The device of claim 1, further comprising a breakout link mounted to said feed shaft rod, said breakout link including a breakout control slot, said feed shall rod connected to a head sleeve including a breakout control pin engaging in said breakout control slot.

7. The device of claim 6, wherein said breakout control slot includes a back section in which said head sleeve is disposed in a retracted, pre-installation position, and a front section in which said head sleeve is disposed in an advanced, breakout position.

8. The device of claim 1, further comprising a head sleeve extending from said feed shaft rod and including a rivet holding head and wherein, in said setting position, said head sleeve and said rivet holding head are disposed a large distance from an exit face of said receiving housing.

* * * * *